US006208122B1

(12) United States Patent
Yuan

(10) Patent No.: US 6,208,122 B1
(45) Date of Patent: Mar. 27, 2001

(54) HIGH FREQUENCY PULSE WIDTH MODULATION OF AC CURRENT FOR CONTROL OF LIGHTING LOAD POWER

(75) Inventor: Edmund En Yuan, Lilburn, GA (US)

(73) Assignee: Triatek, Inc., Norcross, GA (US)

( * ) Notice: Subject to any disclaimer, the term of this patent is extended or adjusted under 35 U.S.C. 154(b) by 0 days.

(21) Appl. No.: 09/407,625

(22) Filed: Sep. 28, 1999

(51) Int. Cl.[7] ..... G05F 1/10; H05B 37/00
(52) U.S. Cl. ..... 323/237; 315/DIG. 4
(58) Field of Search ..... 323/237, 239, 323/241; 363/15, 16; 315/194, 209 R, 219, DIG. 4

(56) References Cited

U.S. PATENT DOCUMENTS

| | | | |
|---|---|---|---|
| 4,086,526 | | 4/1978 | Dieter-Grudelbach . |
| 4,158,164 | | 6/1979 | Diether-Nutz . |
| 4,220,895 | * | 9/1980 | Nuver ..... 315/195 |
| 4,388,563 | * | 6/1983 | Hyltin ..... 315/205 |
| 4,423,478 | | 12/1983 | Bullock et al. . |
| 4,461,990 | | 7/1984 | Bloomer . |
| 4,464,606 | | 8/1984 | Kane . |
| 4,528,494 | | 7/1985 | Bloomer . |
| 4,633,161 | | 12/1986 | Callahan et al. . |
| 4,823,069 | | 4/1989 | Callahan et al. . |
| 4,890,021 | | 12/1989 | Walker . |
| 5,004,969 | | 4/1991 | Schanin . |
| 5,045,774 | | 9/1991 | Bromberg . |
| 5,268,631 | | 12/1993 | Gorman et al. . |
| 5,319,301 | | 6/1994 | Callahan et al. . |
| 5,331,270 | | 7/1994 | Diether-Nutz et al. . |
| 5,365,148 | | 11/1994 | Mallon et al. . |
| 5,550,440 | | 8/1996 | Allison et al. . |
| 5,646,490 | | 7/1997 | Carson et al. . |

OTHER PUBLICATIONS

"Power FET Controlled Dimmer for Incandescent Lamps" C.F. Christiansen, M. Benedetti, IEEE Trans. Ind. Appl (USA) vol. IA–19, No. 3 pt. 1, pp. 323–327 (May–Jun. 1983).

* cited by examiner

*Primary Examiner*—Matthew Nguyen

(57) ABSTRACT

Pulse width modulation of a high frequency series of AC current that is delivered to a lighting load(s) in "slices " of current by a controller device that enables users to dim their loads while minimizing and/or virtually eliminating the externalities associated with current dimming systems.

17 Claims, 6 Drawing Sheets

Fig. 1 Dimming Levels
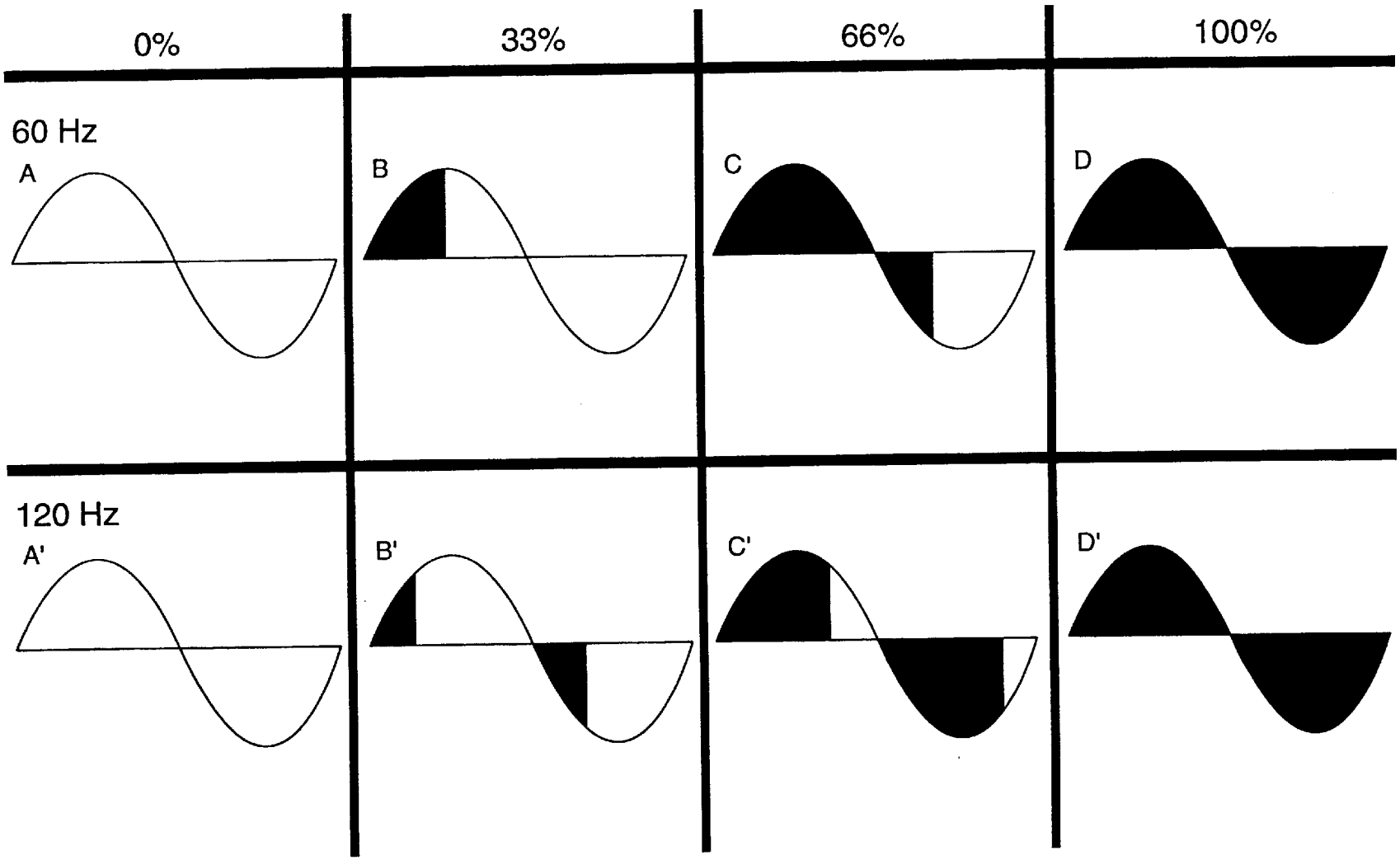

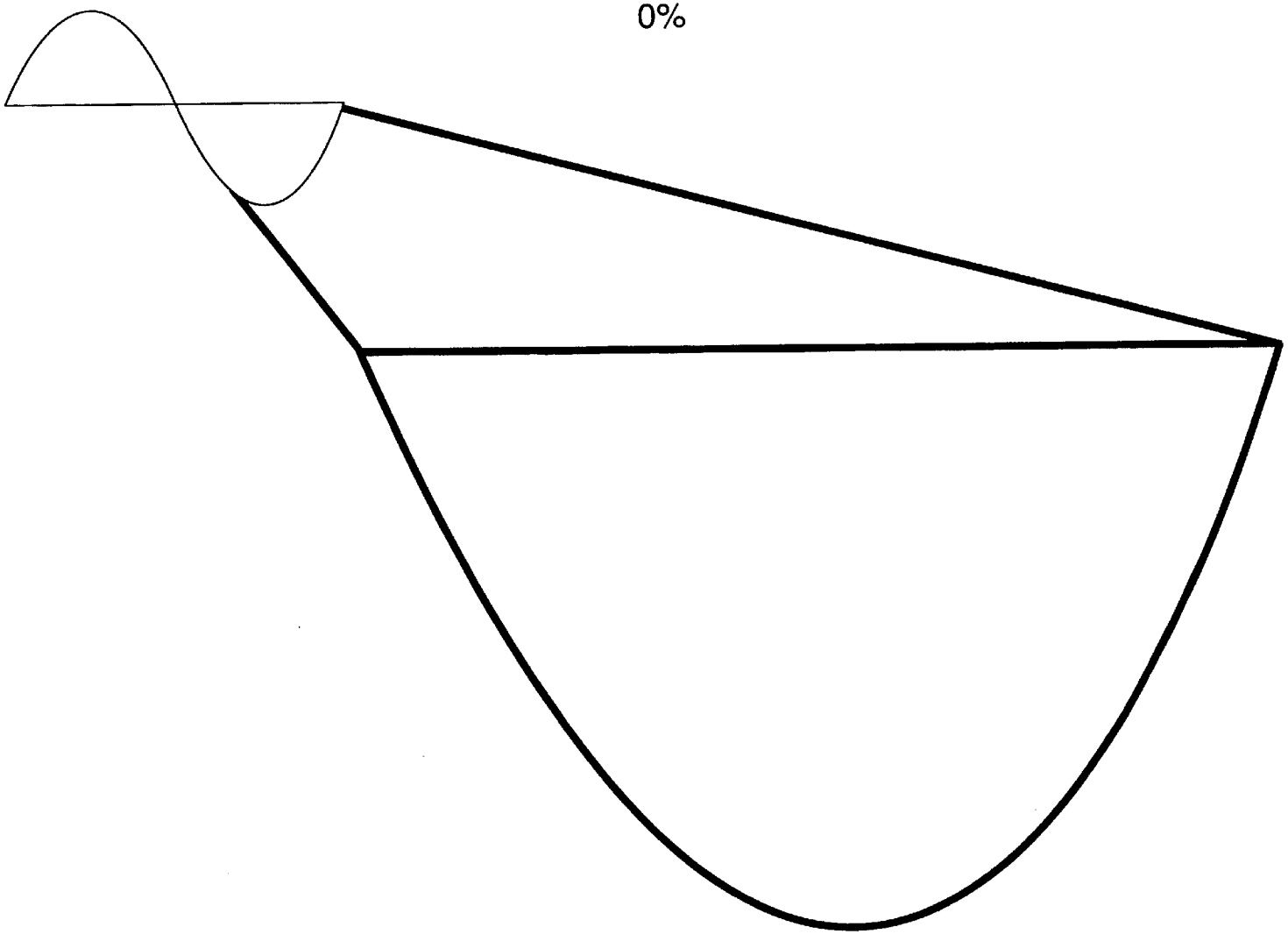
Fig. 2A Dimming Levels With Invention

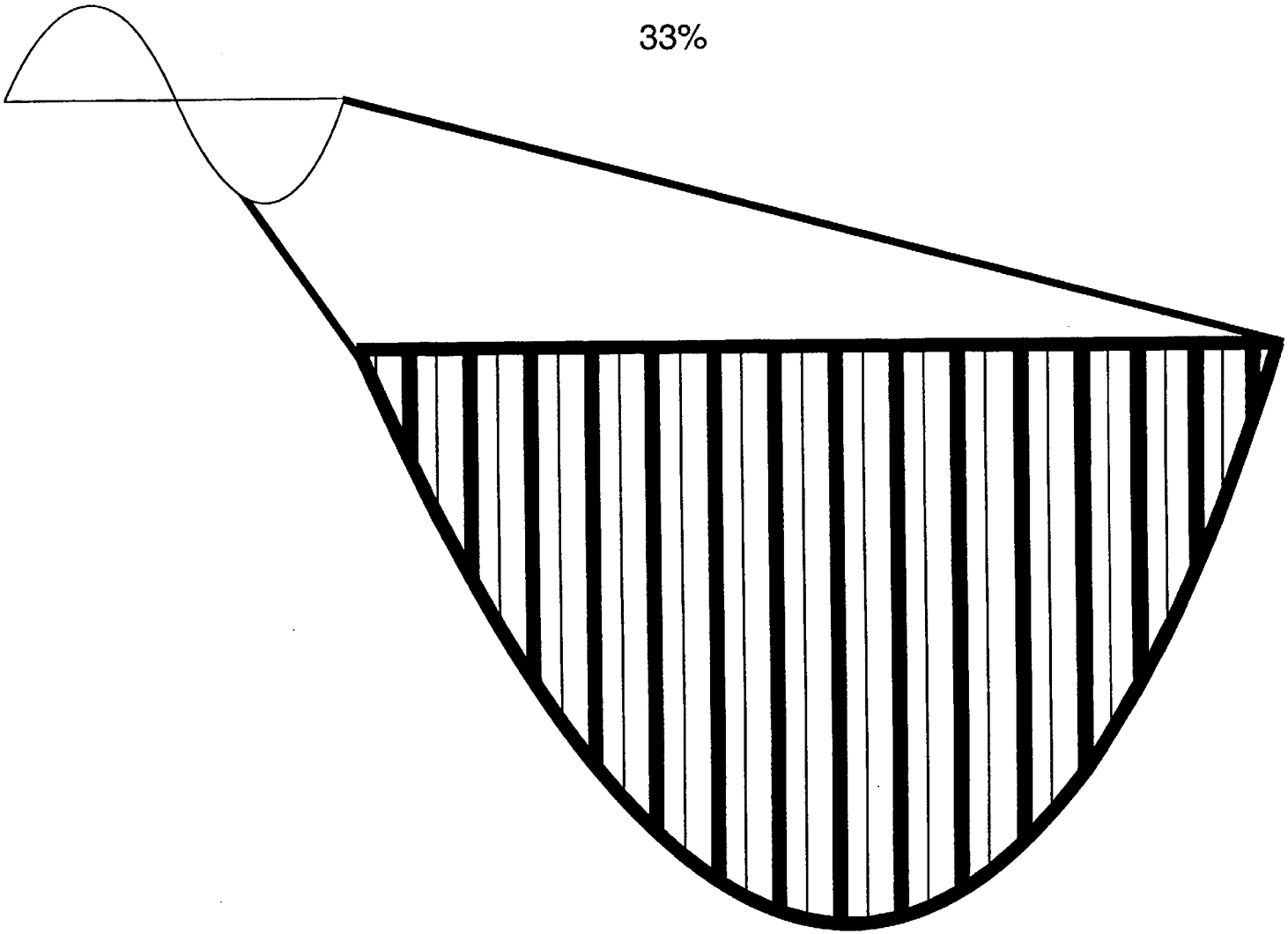
Fig. 2B Dimming Levels With Invention

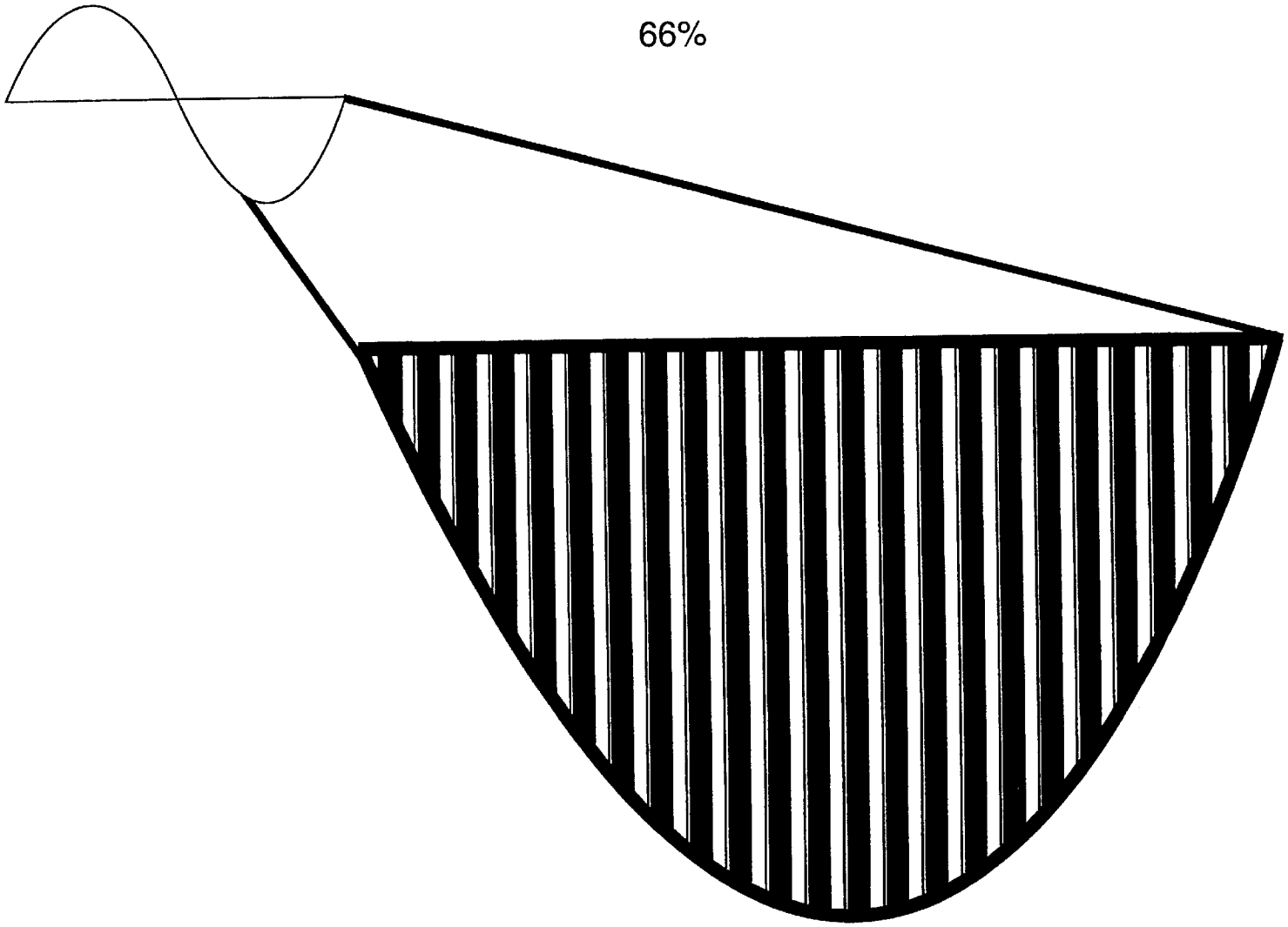
Fig. 2C Dimming Levels With Invention

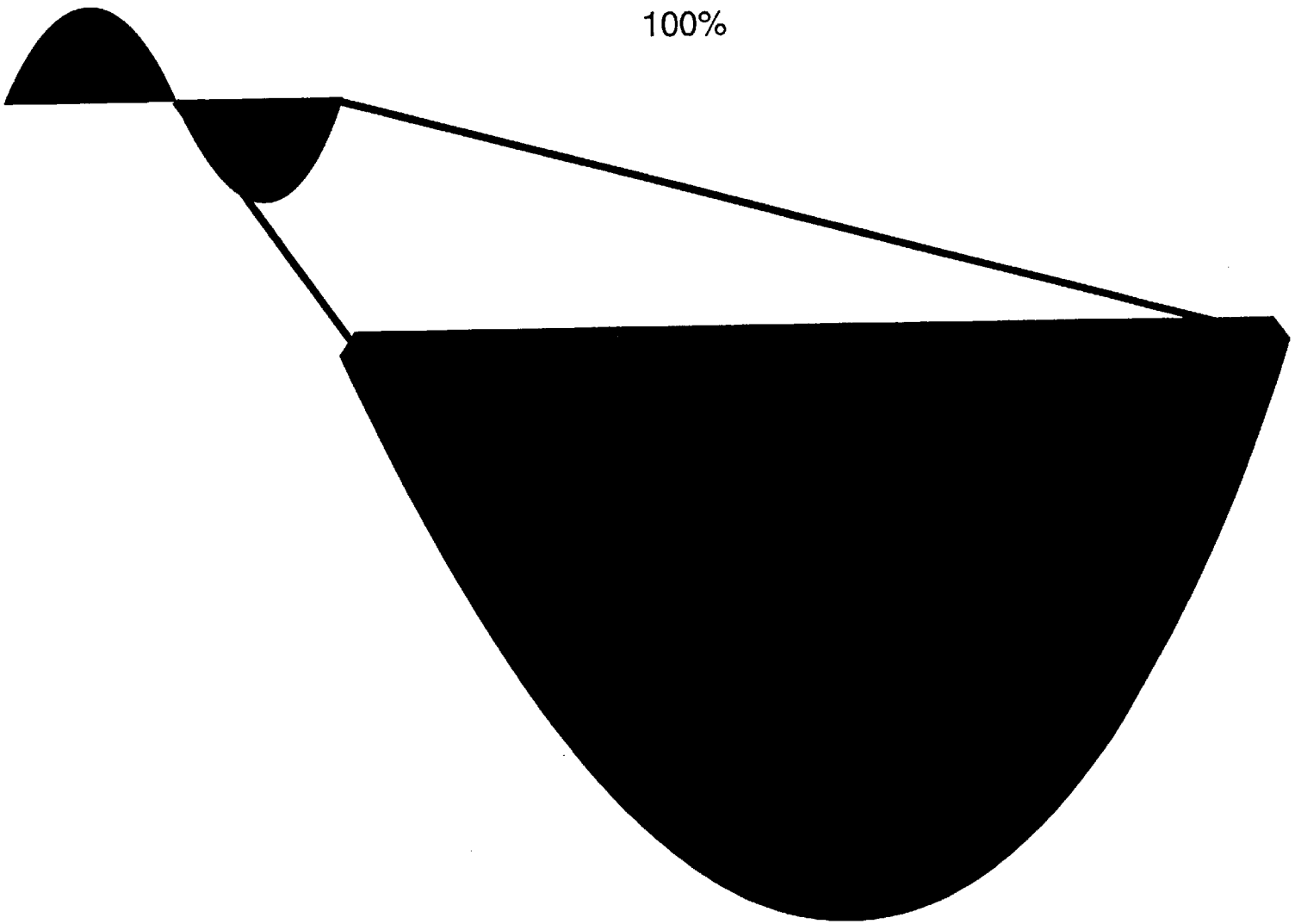
Fig. 2D Dimming Levels With Invention

HIGH FREQUENCY PULSE WIDTH MODULATION OF AC CURRENT FOR CONTROL OF LIGHTING LOAD POWER

BACKGROUND—FIELD OF INVENTION

This invention relates to the control of power supplied to a lighting load to achieve variable intensity, and more particularly to the control of AC powered lighting loads.

BACKGROUND OF THE INVENTION

Dimmable lights are desirable in many contexts and applications including home, office, auto, theater, stadium, arena, and other contexts. Such contexts often require different lighting intensities at different times and different locations within the same structure.

Different methods of achieving dimmable systems in these contexts have evolved over the years. All methods are based on the principle that the illumination intensity of a lighting load will vary proportionally to the amount of power delivered to the load. The most common prior art systems revolve around phase angle control dimming, or variations thereof, which control the amount of power delivered to a load by determining what portion of each AC power cycle or half cycle is delivered to the load. In these instances, TRIACS and/or silicon controlled rectifiers (SCR) are fired at intervals that are a multiple of the power line frequency, typically 120 Hz, to achieve this control. See e.g. U.S. Pat. Nos. 4,080,548, 4,331,914, 4,423,478. The SCR's and TRIACS thereby limit the phase-angle conduction of AC voltage to a controlled AC load.

Hence, through phase control dimming, only a fraction of the power available during each power cycle is supplied to the load that needs to be dimmed resulting in the ability to vary the illumination level of the load from 0% to 100%. The illumination level varies proportionally to the amount of power delivered to the load based on what portion of the power cycle is delivered. This method is visually acceptable because the human eye is unable to discern the rapid flickering of the lighting loads in a dimmed state. While the foregoing capabilities are useful, there are three major deficiencies that remain unaddressed or unsolved by the prior art. While some methods have been employed to resolve one or more of these deficiencies, these methods often result in the addition and/or aggravation of all or some of the original deficiencies. Consequently, it is desirable for a dimming control system such as the one described herein, to minimize or virtually eliminate ALL of the following deficiencies simultaneously. The three deficiencies esoteric to current phase angle control dimming systems today are as follows:

First, phase angle control circuits produce relatively high amounts of acoustical output from the lighting load filaments during the dimming operation resulting in acoustical disturbances to those around the lighting load. This acoustical output results from the load current undergoing a dramatic rise over a relatively small time interval when the controller device is turned "on " to conduction and the resultant instantaneous application of up to 172 volts across the load. In the case of incandescent lighting, this surge in current through the lighting filament will cause the filament and its supports to change their length—otherwise known as "magnetostriction"—and shake the light. The resultant noise, known as "singing" or "lamp-sing" is highly undesirable. Phase angle control systems currently in existence have dealt with lamp-sing by using series chokes or inductors to slow the rise of current in the load. Examples of dimming control systems that have attempted to deal with this "singing" through chokes, inductors, and more recently, inductorless systems are seen in U.S. Pat. Nos. 4,823,069, 5,004,969, 5,365,148, and 5,550,440.

The use of chokes or inductors, however, has not been a satisfactory resolution to deal with "singing" because their use introduces space restrictions that arise based on the generally voluminous and large sizes of chokes or inductors. The added inductors, which are made out of copper and/or iron are generally unwieldy and add significant weight to the control device. Further, inductors also have copper wire wrapped around them to absorb the heat generated by their slow-down of the rise of current in the load. Consequently, inductors have a great size requirement that reduces the density of dimming control devices that are available for any given amount of lighting loads and often leads to unwieldy and expensive setups depending on the application of the dimmer.

Another method intended to circumvent the deficiencies caused by the use of inductors is seen in inventions that have attempted to deal with the inductor problem by introducing MOSFET (MOS-field effect transistor) and/or IGBT (insulated gate bipolar transistor) devices to reverse-phase the switching process to minimize singing and/or the use of inductors as disclosed in U.S. Pat. No. 5,331,270. In these systems, the MOSFET and/or IGBT devices are utilized to detect the zero-cross of the power cycle and deliver power to the load beginning at the zero-cross point. The slow rise of the cycle is then delivered to the load at the slower gradient increase of the power cycle itself which is much more conducive to singing avoidance than the 90 degree "direct rise" conduction that occurs at the peak of the power cycle that results from typical phase control dimming systems. Problems still arise, however, because the sudden "shut-off" of power at the peak of the cycle and the sudden drop of potential presented to a lighting load results in massive heat generation. The substantial amounts of heat that are generated—up to 10 times the normal amount—require additional components to provide for adequate heat dissipation. These additional components, such as heat sinks and other hardware, require significant additional space and, consequently, reduce the density of space and therefore, the potential applications available for a dimming product as seen in U.S. Pat. Nos. 4,633,161, 5,268,631, 5,365,148, and 5,550,440.

The second deficiency with current dimming systems is their phase dependence and the requirement that they detect the zero-cross point of AC current cycles. This dependence requires the products to include additional devices to detect zero-cross (increasing the cost of the product) while also limiting the ability of the dimmer to certain cycles of power. That is, due to its analog nature, zero-crossing detection requires additional comparators, diodes, transistors, and various other analog components such as the pulse-shaping device disclosed in U.S. Pat. No. 4,528,494 which significantly adds to the cost and complexity of dimming systems such as in U.S. Pat. No. 5,004,969.

Finally, the third deficiency seen in many dimming systems is power factor distortion, which results from rapid changes in load voltage and current that are a part of the various phase control dimming schemes previously mentioned. This distortion is often troublesome to power monitoring devices which are unable to accurately monitor the amounts of power that are being sent to the lighting load. Additionally, an even greater issue is the variances in AC power line voltages delivered to the lighting load. As power intensities change, noticeable brightness variations to lighting loads can be seen which are highly undesirable in many dimming contexts such as television, movie, theater, and photography. This issue is noted in U.S. Pat. No. 5,268,631. As lighting designers require precise light levels for various effects, even relatively small distortions and variations can be destructive to their goals. Further, in long wire runs used in these applications between the dimmer and the load, unwanted voltage drops may occur which cause a high-wattage lighting to receive less voltage than it should exacerbating the distortion. Additionally, the sudden rise or drop in load potential introduces unwanted radio frequency interference. This interference is still present in systems that try to gradually "ramp" the applied potential of power to a load as in U.S. Pat. No. 5,365,148.

SUMMARY OF THE INVENTION

The system described herein minimizes and addresses the above-described problems and deficiencies by providing high frequency "chopping" or pulse width modulation of the power delivered to the lighting loads. A switching element such as a MOSFET, IGBT, or other gated pulse controller device is utilized to "chop" the AC power cycle into thin "slices" of current that are evenly distributed over the AC wave form. The width of the AC power slices can then be modulated to deliver the desired amount of power per slice to the load to achieve the desired dimming intensity. Input and output filters may also be used to "smooth" the slices into an attenuated wave that filters the chopped slices into a current cycle that matches the current into the controller device.

By delivering the power to a lighting load in high frequency series of modulated slices, all of the above mentioned deficiencies associated with lighting load dimming are overcome. The high frequency pulsing of current results in no lamp-sing because the high frequency of the slices is beyond the scope of response time for the mechanical components of the load to respond to and for the human ear to discern. There is, thus, no need for cumbersome inductors to absorb the lamp-sing and therefore, minimal heat dissipation issues to be dealt with. As inductors, heat sinks or other heat absorption devices are not necessary, density issues are minimized and there are greater opportunities to arrange dimming configurations that maximize cost-effectiveness, utility and efficiency to end-users.

Further, the high frequency of the slices (i.e. 60 kHz–100 kHz) per half cycle of power eliminates the need for detection of the zero cross points as the high frequency results in an evenly distributed load over the length of the power cycle so that detection of zero-cross is irrelevant. That is, "chopping" the AC power into such high frequencies renders the angle stage of the AC power wave irrelevant as the dimming system focus is on the amount of each slice that is passed to the load rather than on zero cross. Regardless of the stage the cycle is in, the user will obtain virtually the same amount of power needed to achieve their desired illumination level. Finally, power load distortion is minimized and/or eliminated as the high frequency chopping and pulsing of the AC current evenly distribute the power over the entire length of the power cycle.

In the embodiment described herein, the present system achieves the foregoing by utilizing an aforementioned MOSfet, IGBT, and associated controller device to subdivide or "chop" the AC power current into a series of high frequency slices of power over the entire length of the AC current being delivered to the load. The controller can define the width of the slices. The device may also include an input filter that receives the AC current and an output filter that filters the AC current frequency to simulate true dimming. Then, in response to the load user's preference for illumination intensity, the controller device modulates the amount of power in each slice that is delivered to the load. The controller device accomplishes this modulation by pulsing the specific amount of desired power "on" and "off" over the duration of each slice such that the sum of the pulsed "on" power in each slice over one full cycle of power is equivalent to the amount of power needed to achieve the desired illumination intensity in the load. The power is, thus, not delivered to the load in dramatic rises or falls, but is pulsed incrementally to the load through each high frequency slice of potential current. The advantages of this approach are mentioned herein. The controller device is, of course, able to respond to changes in the desired current value as a function of the desired illumination intensity to vary the duration of its on/off pulsing of current in each slice accordingly. The result is dimmable lighting loads that minimize or virtually eliminate the issues mentioned earlier.

DRAWING DESCRIPTION

The system used to achieve dimming and other aspects of the invention, its structure and use will be made even more clear to the person of ordinary skill in the art upon review of the following detailed description and the appended drawings in which like reference numerals designate like items and which are briefly described below.

BRIEF DESCRIPTION OF THE DRAWINGS

FIG. 1 is a diagram of the power waveforms of a conventional dimming system and depicts the potential areas of the waveform that are delivered to the lighting load to achieve various dimming intensities;

FIGS. 2A–2D are diagrams of the power waveform as it is harnessed by the present invention in response to a desired inputted power value to deliver the required amounts of power to the lighting load in a high frequency series of modulated pulses to achieve various dimming intensities;

DETAILS

DETAILED DESCRIPTION OF A PREFERRED EMBODIMENT

Figure 3:
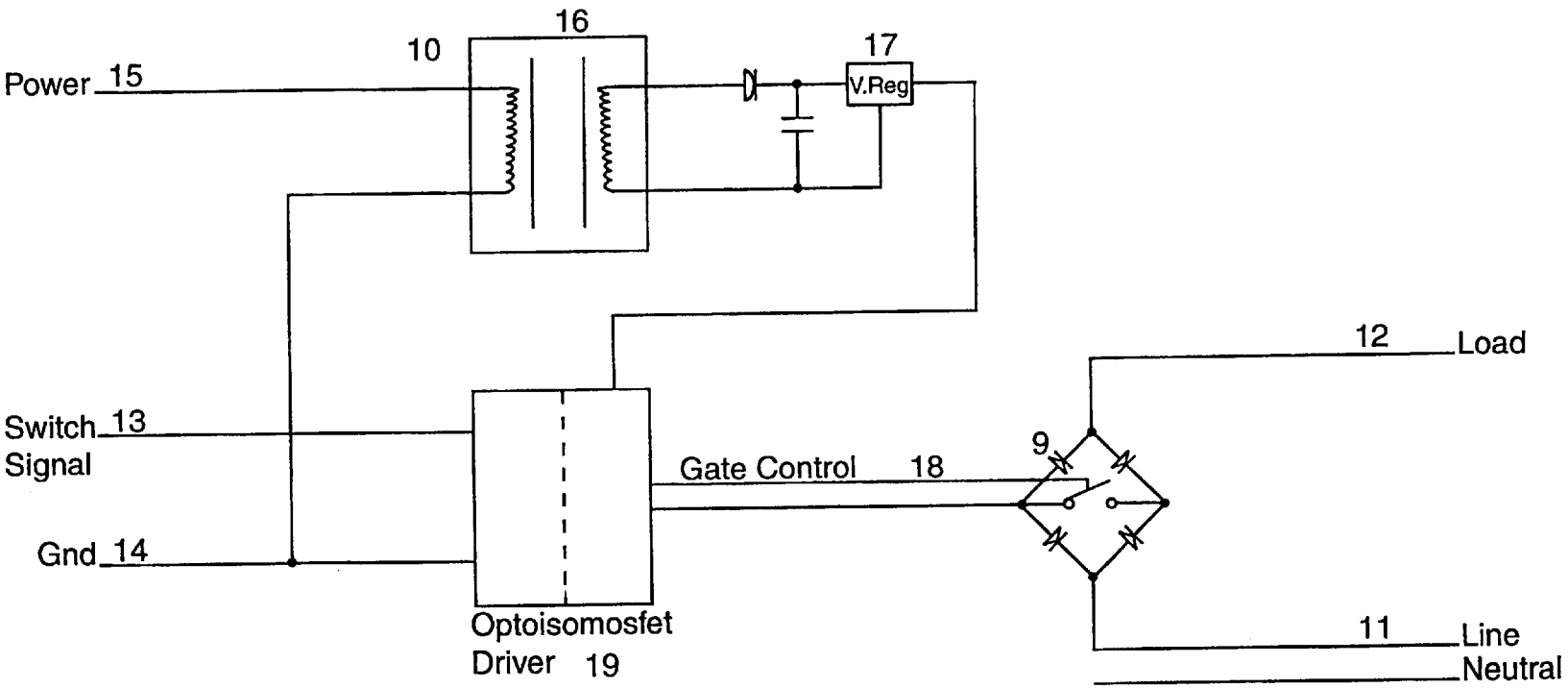
FIG. 3 is a schematic diagram of the preferred embodiment of the invention described herein to achieve the desired dimming intensities in accordance with the parameters of the present invention.

With reference to FIG. 1 there are shown two power waveforms from conventional dimming system that utilizes the typical 60 Hz and 120 Hz phase control devices. Zero light is shown at A and A' in which no output from the power waveform is delivered to the load. This setting illustrates maximum dimming with no illumination from the load. As no power emanates from the phase control device at this setting, no light is generated. At B, an output load of 33% brightness is shown in which a controller device detects zero-cross of the waveform and then delivers 33% of the first part of the waveform to the load to generate the proper amount of brightness. Alternatively at B', another system generates an output load of 33% brightness by detecting the zero cross of the wave form, and then pulsing twice during both half cycles of the waveform at the appropriate times to deliver the appropriate portions of current necessary to generate the desired brightness required by the user and associated load. The width of the pulses from the device are approximately equivalent to the width of one-third of each half cycle of the waveform. Similarly at C an output load of 66% brightness is shown in which a controller device detects zero-cross of the waveform and then delivers 66% of the first part of the waveform to the load to generate the proper amount of brightness. Alternatively at C', another system generates an output load of 66% brightness in which the phase control device discerns the zero cross of the power waveform, and then pulses accordingly to provide the load with approximately two thirds of the width of each half-cycle of the power waveform to produce 66% brightness in the load. Finally, at D and D' there is a 100% output brightness in which the phase control devices deliver 100% of the power waveform to the load resulting in zero dimming and 100% illumination in accordance with the load's capability. Note that in B, B', C and C', the sharp rises and falls in power being delivered to the load produce the deficiencies associated with these dimming systems.

With respect to FIGS. 2A–2D, the present invention "chops" the wave form into a high frequency series of potential current over the length of the waveform. To achieve dimming, the controller device modulates the amount of potential power in each slice that is pulsed to the load such that the sum of the slices in one power cycle pulsed to the load equate to the amount of power needed for the desired dimming intensity. For instance, in 2A, the zero output configuration, no power is delivered in any of the chopped slices of potential power across the length of a complete waveform resulting in maximum dimming and no illumination from the load. In 2B, where there is a desired 33% intensity, the controller device of the present invention pulses 33% of the potential power in each chopped slice of potential power to the load so that 33% illumination is achieved. Note that while this diagram depicts the controller device harnessing power over the length of a typical waveform, the device does not regard the phase of the waveform nor does it need to detect zero-cross. The high frequency series of slices allows the controller device to focus only on the width of each slice and the amount of current in each slice that is delivered to the load in response to a desired illumination level regardless of the phase the waveform is in, and then simply pulses "off" the rest of the potential power in each slice so that the sum of the "on" portions of the slices in any one waveform provide the necessary output for the required dimming intensity. Where 66% intensity is required as in 2C, the controller device of the present invention pulses 66% of the potential power in each chopped slice to the load so that 66% illumination is achieved. Finally, where 100% intensity is required as in 2D, the controller device pulses 100% of the potential power in each slice across the waveform.

In FIG. 3, a schematic diagram is shown depicting the operation of the invention 9 in conjunction with a controller 10, the AC power source 11 and the lighting load 12 to be dimmed. The controller 10 depicted here (which could be any infinite array of devices but for illustrative purposes here) comprises a signal switch 13, ground 14, power source 15, transformer 16, and voltage regulator 17 that responds to a user's desired setting for a particular dimming level. Thus, in this embodiment the controller includes a power source 15 which feeds into the transformer 16 that is attached to the voltage regulator 17. These in turn, are tied into the controller driver 19 which receives switch signals 13 from the users who desire the specific dimming level. There is also a ground wire 14 attached to the driver. Note that these items are not part of the invention but are provided for illustrative purposes to depict how the invention would function in accordance with a typical dimming control arrangement.

The controller 10 sends a signal through the gate control line 18 to the invention 9 which then chops the AC power source 11 into the high frequency series of power slices that can be delivered to the lighting load 12. The invention 9 has input and output filters associated with it to filter the high frequency of slices so that the output current delivered to the load matches the current entering the controller device. In response to the desired dimming level inputted to controller 10, the invention 9 pulses the requisite amount of AC power in each slice to the lighting load 12 to achieve the desired dimming level. If a different dimming level is desired, the user inputs a different value into the controller 10 which, in turn, sends a revised signal through the gate control line 18 to the invention 9 so that it can modulate the potential AC power being delivered to the lighting load with the revised amount of pulsed power to the load 12 which accomplishes the desired dimming level.

To control dimming of the lighting load, the output of the AC power 10 is controlled by the invention 9. Without regard for the particular phase cycle of the waveform or the zero-cross point, the invention 9 "chops" the AC power waveform into a high frequency series of slices of current that each contain a tiny amount of the power from the waveform. The invention 9 is then able to pulse any amount of the power in the "slice" to the load 18 in accordance with the desired dimming level. The invention 9 is able to modulate the amount of load pulsed to the load in each slice such that the width of the pulse controls the period during which power is transmitted to the load 18 such that the sum of power delivered to the load in each slice is the amount of current necessary to achieve the desired dimming levels. This is true irregardless of the particular phase or location of the waveform at the time an inputted value for dimming is required. See previous FIG. 2 for more on this.

By modulating the pulsed power in each chopped slice that is delivered to the load, all previous problems associated with prior dimming systems are minimized and/or eliminated. There is no longer any "singing" because the high frequency pulsing is beyond the range of hearing capability for humans. Heat generation issues are minimized as an insignificant amount of heat is generated in contract to the massive amounts of heat generated by the sudden "on" and "off" of previous cycles. Further, inductors are not needed so space is saved and the density of dimming panels can be increased. Additionally, there is no longer any need for phase control sensing or zero-cross detection. Finally, power factor distortion and interference are virtually eliminated due to the regulated pulsing of power within the high frequency context.

While the foregoing constitutes a preferred embodiment of the invention, according to the best mode presently contemplated by the inventor of making and carrying out the invention, the invention is not limited to the embodiment described. In light of the present disclosure, various alternative embodiments will be apparent to those skilled in the art. Accordingly, changes can be made without departing from the scope of the invention as pointed out and distinctly claimed in the appended claims as interpreted literally or expanded to include all legal equivalents.

What is claimed is:

1. A method of operation for dimming a load through the use of a dimming system comprised of a controller device that has the capability to chop power current to a lighting load into a high frequency series of individual slices of current that can be supplied to a lighting load in response to a control signal without needing to rectify or invert the power current and also without regard to whether a non-polar or uni-polar switching device is utilized.

2. The dimming system as recited in claim 1, wherein said controller device receives an inputted value indicating a desired power current amount appropriate for said lighting load to achieve the desired illumination intensity.

3. The dimming system as recited in claim 2, wherein said controller device chops the potential power to the load into a high frequency series of individual slices of current that can be supplied to a lighting load.

4. The dimming system as recited in claim 3, wherein said controller device has the ability to modulate the amount of current delivered to the load in each high frequency slice by pulsing the current on in each slice of current in accordance with the desired illumination intensity.

5. The dimming system as recited in claim 4, wherein said controller device modulates the amount of current delivered to the load in each high frequency slice by, after pulsing the current on in each slice of current as noted in claim 4, pulses the current off for the remainder of each slice in accordance with the desired illumination intensity.

6. The dimming system as recited in claim 5, wherein the sum of the power in each high frequency slice delivered to the lighting load is equal to the necessary current supply needed by the lighting load at any given point in time per power cycle in response to the inputted power value for the desired illumination intensity.

7. The dimming system as recited in claim 6, wherein said controller device has input and output filters associated with it to filter the high frequency series of slices so that its output to the load closely resembles a true AC current wave.

8. The dimming system as recited in claim 7, wherein said controller device, in response to the desired inputted power value referenced in claim 2, can respond to a change in the desired power current amount appropriate for said lighting load.

9. The dimming system as recited in claim 8, wherein said controller device, in response to a change in the desired inputted power value referenced in claim 8, modulates the high frequency slices to pulse a revised amount of current per slice to the load.

10. The dimming system as recited in claim 9, wherein said controller device pulses the current on in each high frequency slice of current in accordance with the revised and desired amount of current.

11. The dimming system as recited in claim 10, wherein said controller device pulses the current off in each high frequency slice of current in accordance with the revised and desired amount of current.

12. The dimming system as recited in claim 11, wherein the sum of the modulated power in each high frequency slice delivered to a lighting load is equal to the necessary current supply needed by the lighting load at any given point in time per power cycle in response to the revised inputted power value for the desired and revised illumination intensity of a user.

13. The dimming system as recited in claim 12, wherein said system can control the amount of load in the manner described to a plurality of loads networked to the controller device.

14. The dimming system as recited in claim 13, wherein said system can be scheduled from a network device such as a PC, Personal Data Assistant or other Programmable device.

15. The dimming system as recited in claim 14, such that it is adapted for use in a distributed dimmer system.

16. The dimming system as recited in claim 15, such that said distributed dimmer system comprises at least one alternating current supply and a plurality of lighting loads spaced in various locations.

17. The dimming system as recited in claim 16, such that a plurality of dimmer enclosures are adapted to be located at various locations in proximity to the distributed lighting loads.

* * * * *

UNITED STATES PATENT AND TRADEMARK OFFICE

CERTIFICATE OF CORRECTION

PATENT NO. : 6,208,122 B1
DATED : May 2, 2001
INVENTOR(S) : Edmund En Yuan chow

It is certified that error appears in the above-identified patent and that said Letters Patent is hereby corrected as shown below:

Inventor should be listed as, -- Chow, Edmund En Yuan --, instead of present listing which is "Yuan, Edmund En"

Signed and Sealed this

Twenty-second Day of January, 2002

*Attest:*

*Attesting Officer*

JAMES E. ROGAN
*Director of the United States Patent and Trademark Office*